United States Patent [19]

Rütten

[11] 3,956,791

[45] May 18, 1976

[54] BOTTLE WASHING MACHINE

[75] Inventor: Werner Rütten, Erkrath, Germany

[73] Assignee: Anton Huber, GmbH & Co. KG, Freising, Germany

[22] Filed: Dec. 9, 1974

[21] Appl. No.: 530,963

[30] Foreign Application Priority Data

Dec. 18, 1973 Germany ..... 448201[U]

[52] U.S. Cl. ..... 15/302; 15/304; 15/305; 134/79; 134/152

[51] Int. Cl.[2] ..... B67B 1/06

[58] Field of Search ..... 15/302, 304, 305; 134/152, 153, 157, 159, 169 R, 170, 79

[56] References Cited

UNITED STATES PATENTS

| | | | |
|---|---|---|---|
| 1,046,062 | 12/1912 | Felt | 134/159 X |
| 1,209,849 | 12/1916 | Kintzele | 134/159 X |
| 2,202,344 | 5/1940 | Hamilton et al. | 134/159 |
| 3,302,655 | 2/1967 | Sasaki et al. | 134/152 X |

FOREIGN PATENTS OR APPLICATIONS

| | | | |
|---|---|---|---|
| 85,531 | 6/1920 | Switzerland | 134/159 |
| 256,276 | 3/1912 | Germany | 134/159 |
| 654,194 | 12/1937 | Germany | 134/159 |

*Primary Examiner*—Leonard D. Christian
*Assistant Examiner*—C. K. Moore
*Attorney, Agent, or Firm*—Flynn and Frishauf

[57] ABSTRACT

To permit versatile application of a washing machine for bottles of different sizes and shapes, a rotatable frame is located within a vessel, the frame having secured thereto a plurality of bottle holding, or retaining boxes, each adapted to hold one, or more bottles, which boxes are made of mesh, or similar material, and have an open top, the frame being arranged with holding means for mesh, grid or other tops, at different heights above the bottoms of the boxes; the frame rotates in the vessel, to dip the bottles into cleaning, rinsing and other treatment solutions and, when the bottles are facing upside down, spray means are arranged to spray washing liquid into the bottles. The vessel may be strong enough to accept pressurized steam for sterilization of the wash bottles.

12 Claims, 8 Drawing Figures

BOTTLE WASHING MACHINE

The present invention relates to bottle washing machines, and more particularly to bottle washing machines to permit cleaning of bottles used in the pharmaceutical industry and which may be of different sizes and shapes.

Bottle cleaning plants used in the beverage industry are usually designed for high quantity production; they are not suitable for many applications, for example in the pharmaceutical industry, since their initial investment is expensive, and operation thereof is costly. Such systems also can be adapted to bottles of different sizes only with difficulty, and the cleaning efficiency, for many applications, leaves something to be desired.

It is an object of the present invention to provide a bottle cleaning machine which has a lower output than that of the known, continuously operating bottle cleaning machines, which has particularly low intial costs and operating charges, which can easily be matched to bottles of different sizes, which has a cleaning effectiveness satisfying even high requirements and which, if desired, also permits other treatment of the bottles, and which, therefore is particularly suitable for the pharmaceutical industry.

Subject matter of the present invention: Briefly, a plurality of bottle holding boxes are provided, adapted to hold one or more bottles of similar size in a respective box, although the bottles in different boxes may well differ from bottles in other boxes; the boxes, preferably of mesh, grid material or the like, preferably, are open at the top, and are secured in a rotatable frame located within a vessel. The frame is rotated by a drive means coupled thereto, to expose the bottles to treatment fluid, such as rinsing fluid, detergent washing solution, and the like, in which the bottles are dipped; preferably, a spray tube is so arranged that the interior of the bottles will also be reached and cleaned. If sterilization of the bottles is desired, the vessel should be of sufficient strength to accept steam pressure, so that the clean bottles can then be sterilized. Air drying may also be provided.

The term "bottle" as used herein relates, in general, to articles to be cleaned and which have interior hollow spaces, and is deemed to include jars and the like, regardless of the material, which may glass, plastic, metal, or any other materials suitable for containers or vessels.

The bottles to be cleaned are dipped into a washing liquid, and moved therein, in contrast to known, continuously operating bottle cleaning apparatus using the customary spray nozzle rinsing arrangement. Moving the bottles about in the washing fluid results in substantially more thorough and reliable cleaning thereof. The bottles to be cleaned are located in holders, hereinafter referred to as "boxes" in which they may remain during cleaning, if desired sterilization, and subsequent drying; in certain embodiments of the invention, sterilization and drying can be carried out in the bottle cleaning machine. The bottles may remain in their holders or boxes for subsequent treatment as well, for example for filling, freeze-drying, closing, or the like. The present bottle cleaning machine can easily be adapted to various types of boxes or holders used by customers. Since the machine can be constructed similarly to a known washing machine used in industry (see, for example, German Disclosure Document DT-OS 1,710,539), except for the rotatable frame, many customarily used and reliable components can be used in the present machine, thus reducing cost of manufacture.

The invention will be described by way of example with reference to the accompanying drawings, wherein.

Figure 1:
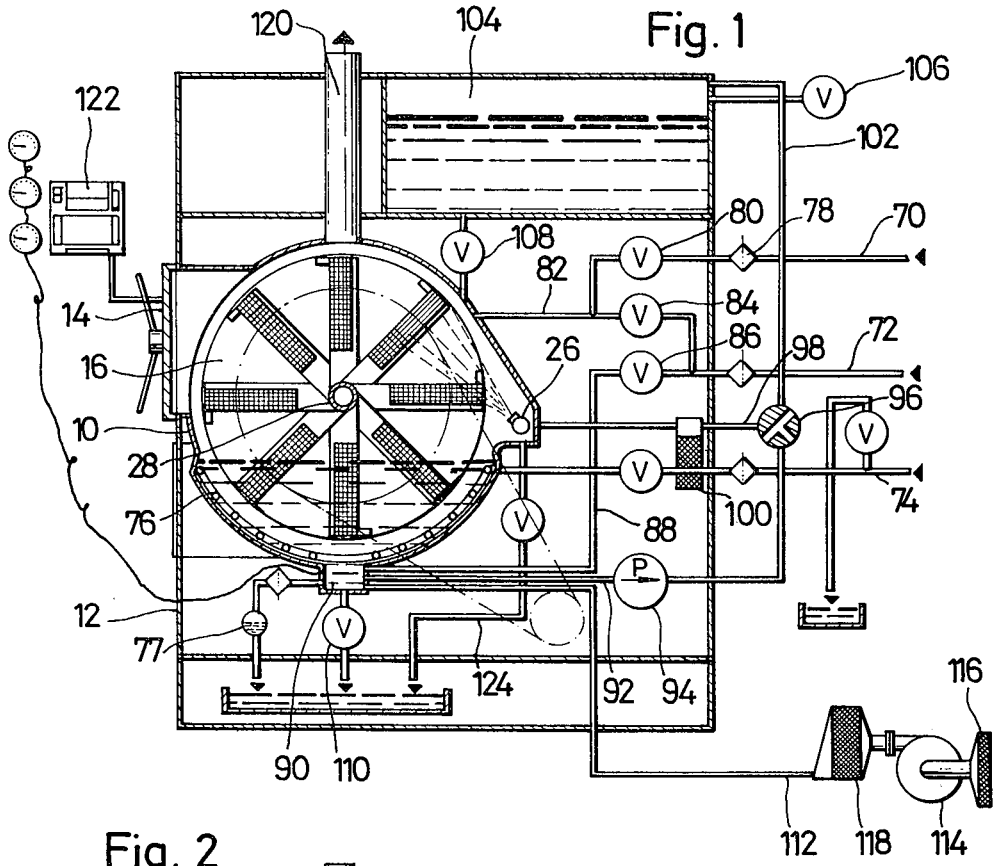
FIG. 1 is a simplified cross-sectional view of a bottle cleaning machine in accordance with one embodiment of the present invention, and a schematic illustration of the associated piping and control system.
Figure 2:
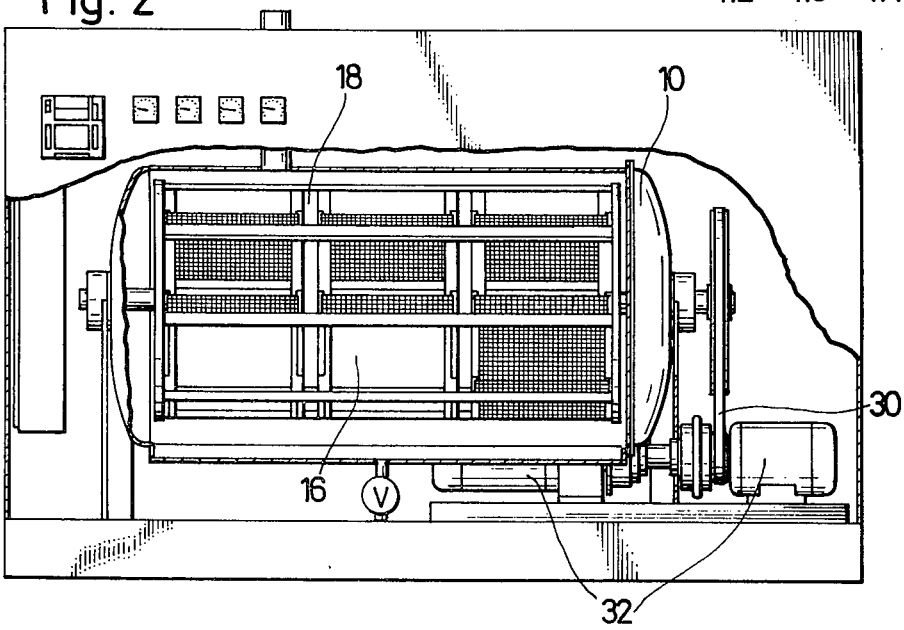
FIG. 2 is a front view of the machine of FIG. 1; the outer housing and the washing fluid vessel of the machine are partially broken away so that the interior of the machine is visible.

The bottle cleaning machine illustrated in FIGS. 1 to 6 may, in principle, be constructed similarly to an industrial-type washing machine. It includes a washing liquid vessel 10 which is supported in a frame, not further shown, and is surrounded by an outer housing 12. A door 14, which can be locked, is located in the front upper portion of the vessel 10 (at the left side of FIG. 1).

The washing liquid vessel 10 is connected to a piping or duct system to receive and to drain washing liquid, rinse water, treatment liquids, test liquids, and the like, as will be explained in detail below.

A frame 16 is rotatably mounted within the vessel 10. In the example shown, it has eight radially extending arms and is sub-divided into three axial portions by two intermediate walls 18. Each portion of each arm forms a holder to receive boxes, or cassettes 22 (FIG. 6) in which the bottles 24, to be cleaned, may be located. These cassettes are liquid pervious and may be made, for example, of wire mesh, perforated sheet metal, or the like. The boxes or cassettes 22 are sub-divided by inserts, or intermediate walls 20 into compartments, each of which can accept one bottle.

The vessel 10 preferably includes a laterally located spray pipe 26 which provides streams of liquid directed upwardly at an inclination.

Frame 16 is rotatable about a horizontal shaft 28. It is connected with a drive unit 32 by means of a V-belt drive system 30; preferably, the drive system or unit permits reversible drive of the frame 16.

Figure 3:
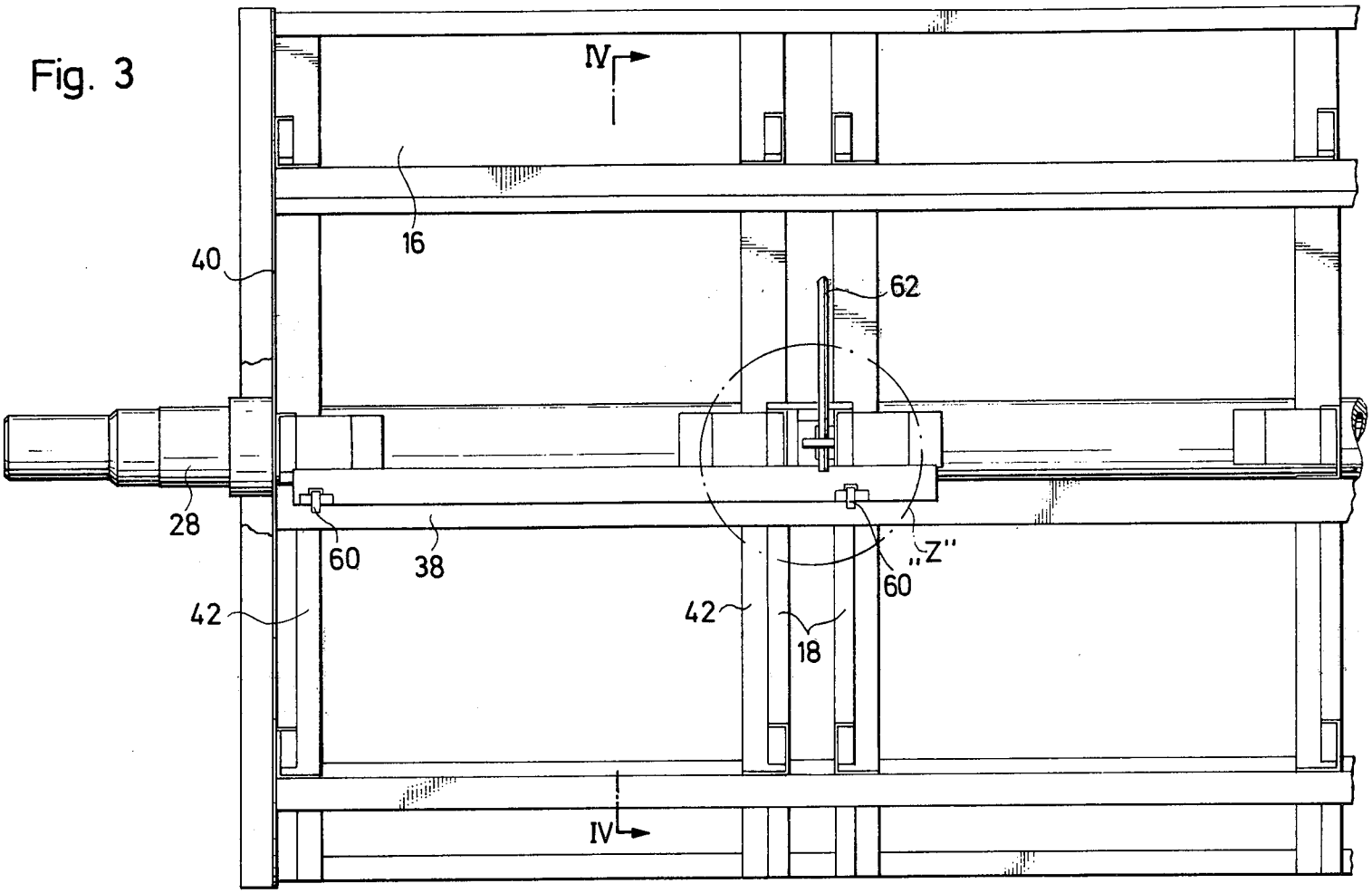
FIG. 3 is a side view of one half of a preferred embodiment of a rotating frame for the bottle cleaning machine in accordance with FIGS. 1 and 2 to a larger scale than FIGS. 1 and 2.
Figure 4:
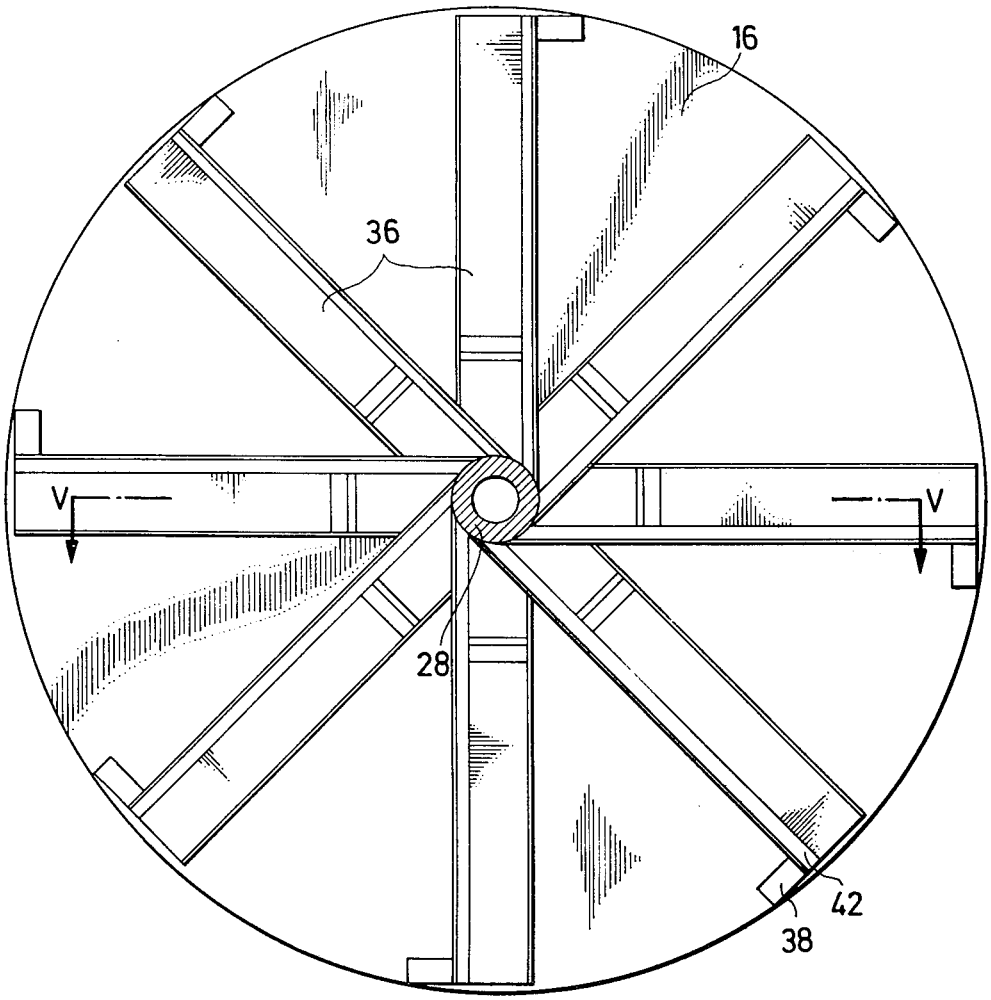
FIG. 4 is a cross section along line IV of FIG. 3.

Frame 16 is shown in greater detail in FIGS. 3-6. It has eight arms 36 (FIG. 4). The arms are secured at the inner end to the hollow shaft 28; their outer ends are supported by connecting rails 38. End walls 40 are located at the axial ends of the frame; one of the end walls is seen in FIG. 3.

The holders for the perforate boxes 22 include two support tracks 42, on which the boxes may slide upon being inserted; the bottles may rest on the tracks during treatment of the bottles 24 within the boxes. The boxes 22, and the bottles 24 contained therein, are secured by perforate covers 44, so that they cannot fall out when the frame 16 rotates during the washing and treatment steps.

Figure 5:
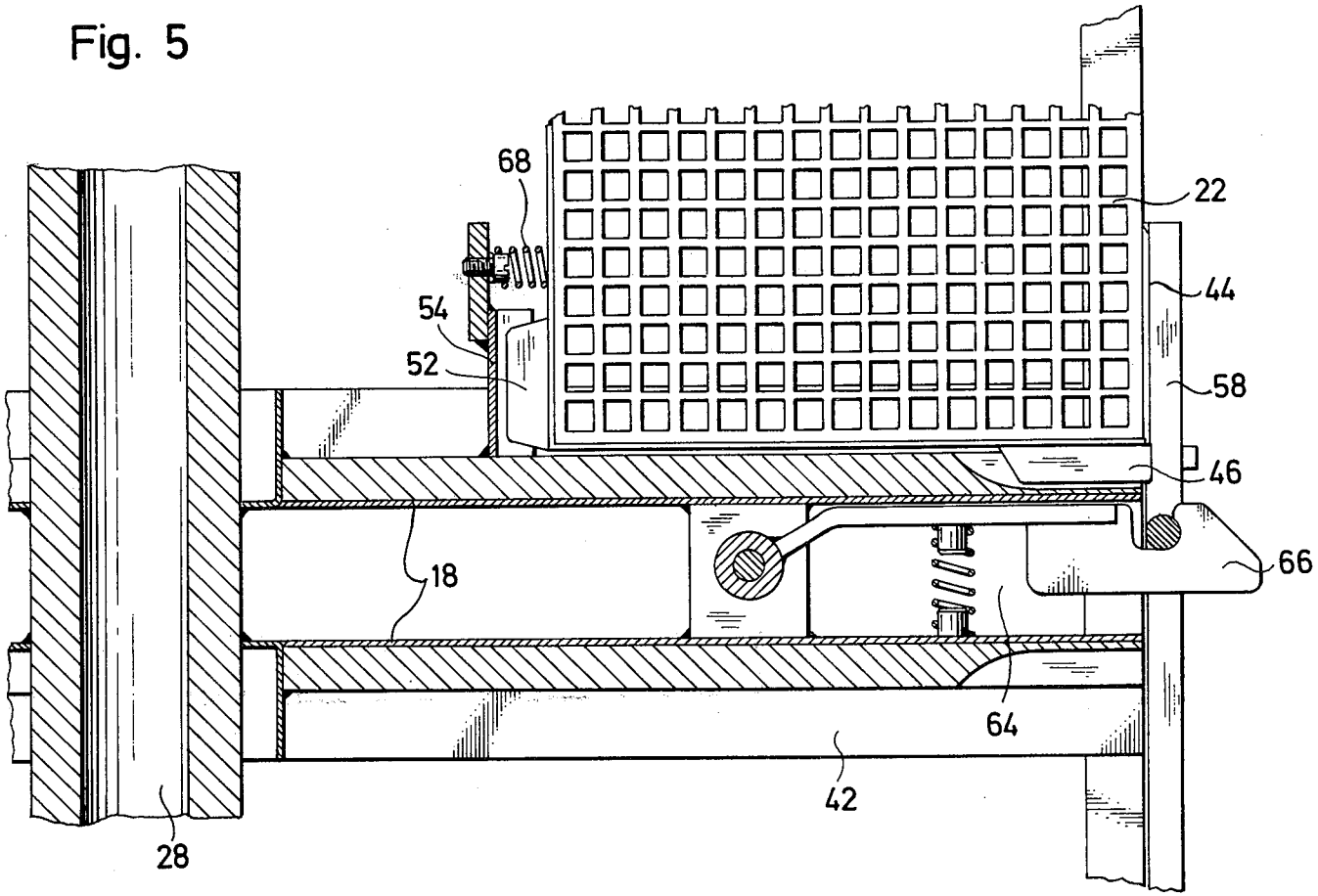
FIG. 5 is a partial cross section in the plane V—V of FIG. 4.
Figure 6:
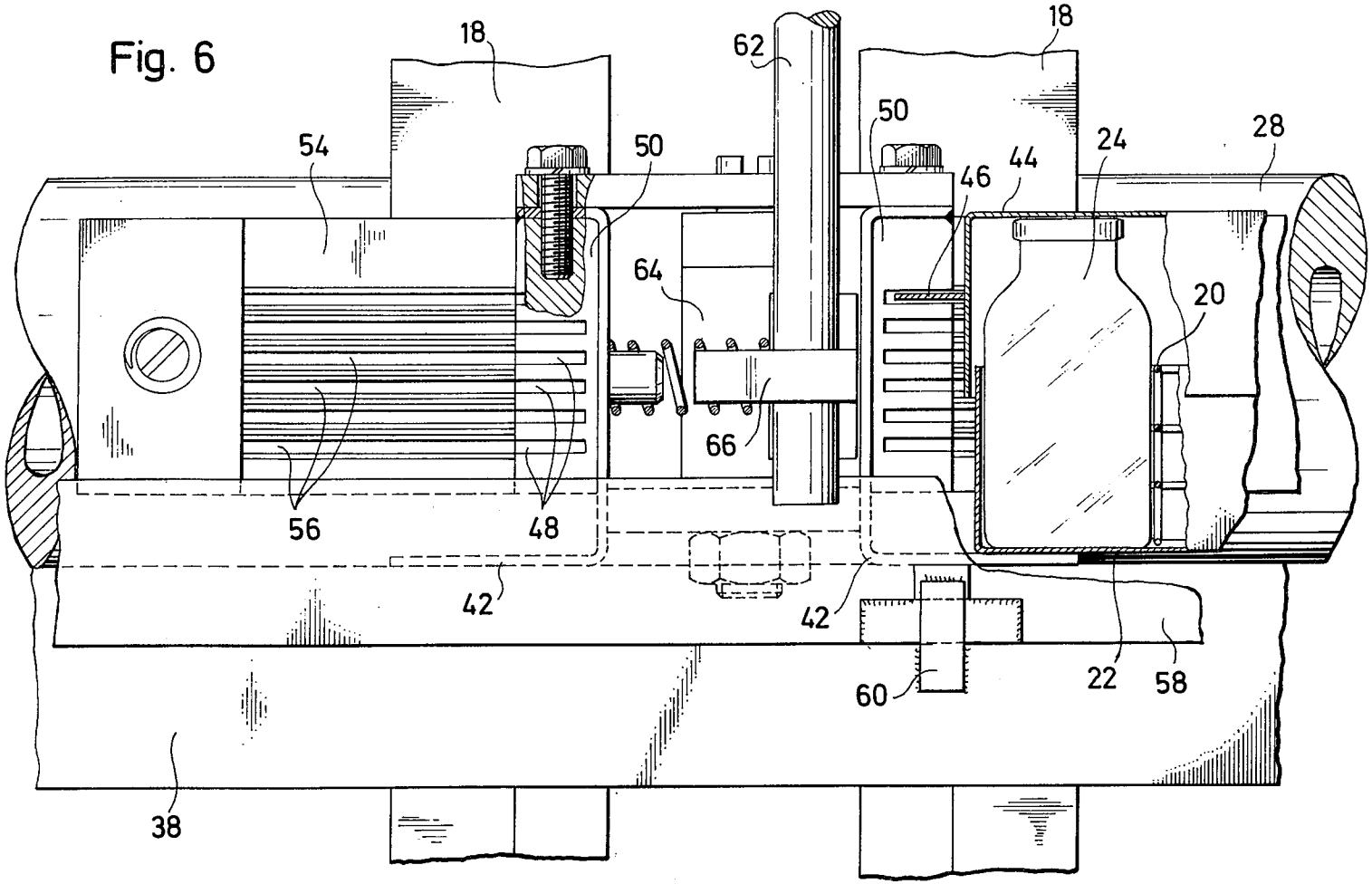
FIG. 6 is a detail view of the region within the circle "Z" of FIG. 3.

The covers 44 are formed at the front end of their side walls with two respective holding projections 46 (one of which is seen in FIG. 5). If a box 22, with the associated cover 44, is inserted into the frame, the projections 46 fit into one of a plurality of grooves 48 formed in lateral guide rails 50. The rear wall of the covers is likewise formed with a holding projection 52, at the right and left side (FIG. 5), which fits in an associated guide rail 54, likewise formed with a plurality of cut-outs or grooves 56. The cut-outs or grooves 48, 56 easily permit matching to various sizes of bottles. If smaller bottles are in the box, the cover 44 extends farther over the associated box 22 and the holding projections are secured in deeper cut-outs 48, 56, respectively. The bottles, therefore, have only little play and cannot be damaged upon rotation of the frame.

The arrangement formed of the boxes 22 and covers 44 is prevented from falling out in front from the respective arm of the frame by means of a holding rail 58. Each one of the arms is provided with a holding rail 58. Rails 58 are pivotable about hinges 60 secured to the associated connecting rails 38, to be swingably mounted thereon. Each holding rail 58, when swung upwardly, can be locked in the position in which it prevents the associated boxes from falling out. To this end a lever 62 is provided, secured to the partition walls 18 and engaging the holding rails 58; when flipped upwardly, the lever 62 engages with rail 58 and is held by means of a holding catch 66 forming part of a lock 64, which is spring-loaded, and which permits ready release. Each box 22 is pressed forwardly towards the rail 58 by means of a spring 68 (FIG. 5) in order to prevent back-and-forth sliding of the box as the frame rotates.

The bottle cleaning machine illustrated in FIG. 1 is connected with a warm-water supply pipe 70, a cold-water supply pipe 72 and a steam supply pipe 74. The steam supply pipe 74 is connected to a heating coil 76, located in the lower portion of the vessel 10. The end of the heating coil is connected to a condensate removal line 77.

The warm-water supply 70 includes a filter 78 and is connected over a valve 80 with a pipe 82 which terminates in the vessel 10. The cold water supply branches to valves 84 and 86. Valve 84 connects to pipe 82 and valve 86 connects with a pipe 88 which terminates in a drain stub 90 located at the lower portion of the vessel 10. A pipe 92 which includes a pump 94 is connected to the drain stub 90, the pump 94 supplying liquid sucked from pipe 92 to a threeway valve 96. Three-way valve 96 is further connected to a line 98 which leads over a fine filter, or a bacterial filter 100 to the spray pipe 26. Valve 96 is also connected to a third line 102 which leads to a vessel 104 located above the washing liquid vessel 10. The vessel 104 further includes a supply line 106, in which a valve is located, for selective supply of additives, treatment substances and the like; it is further provided with a drain line 108, in which a valve is located, and which leads to the washing vessel 10.

A drain valve 110 is connected to the stub 90. A line 112 is further connected to the stub 90, through which air may be blown into the vessel 10 through a blower 114. Air is sucked from atmosphere by means of a coarse filter 116, then passes through blower 114 and is supplied over a sterile, or fine filter 118 to line 112. A vent pipe 120 is provided at the upper portion of vessel 10.

All valves are preferably electrically controllable magnetic valves which can be controlled by a suitable program, commanded by a program controller 122.

Devices to provide for metering and introduction of cleaning substances, and the like, into the vessel 10 may be provided.

The lateral projection, or bulge of the vessel 10 in which the spray tube 26 is located is connected with a drain line 124, in which a valve is also included.

Operation: The apparatus of the present invention permits intensive cleaning as well as a number of different types of treatment. For rough, or first cleaning, warm water, cold water, or a mixture thereof is supplied over duct 88 to fill the vessel 10, and the valve in the pipe 124 is opened so that, simultaneously, water overflows and scum may drain away. Frame 16 is rotated simultaneously. Pre-cleaning may be assisted by pumping water into the spray tube 26 by means of pump 94, pipe 92, and three-way valve 96. The liquid is sprayed by means of the spray tube into the bottles at the side of the frame in which the openings point downwardly.

After pre-cleaning, which may include a number of steps, as described, and which may be carried out with the assistance of detergents and the like, the treatment fluid is drained and the vessel 10 is filled over pipe 108 with rinse liquid, especially with de-ionized water from the container 104. The rinse liquid is supplied, as the washing and cleaning fluid before, by means of pump 94 to the spray tube, and the bottles are final-rinsed with the rinse liquid. The rinse liquid may be pumped back into the container 104 to be re-used at the next rinsing step over the three-way valve 96 and pipe 102 after termination of that treatment step. The liquid may be heated by the heating coil 76 during all washing steps.

The bottles can be dried in a sterile air stream after cleaning and draining of the liquid. The sterile air stream is introduced into the vessel 10 by the blower 114.

Various containers may be provided rather than one container 104, the various containers containing, for example, different cleaning fluids or, in part for example, testing substances to test for cracks or fissures, or the like, and which are suitably connected by means of a piping system.

The washing vessel 10 may be made to have sufficient strength, that is, be sufficiently pressure-resistant and be connected to a steam pressure line so that sterilizing can be carried out.

Figure 7:
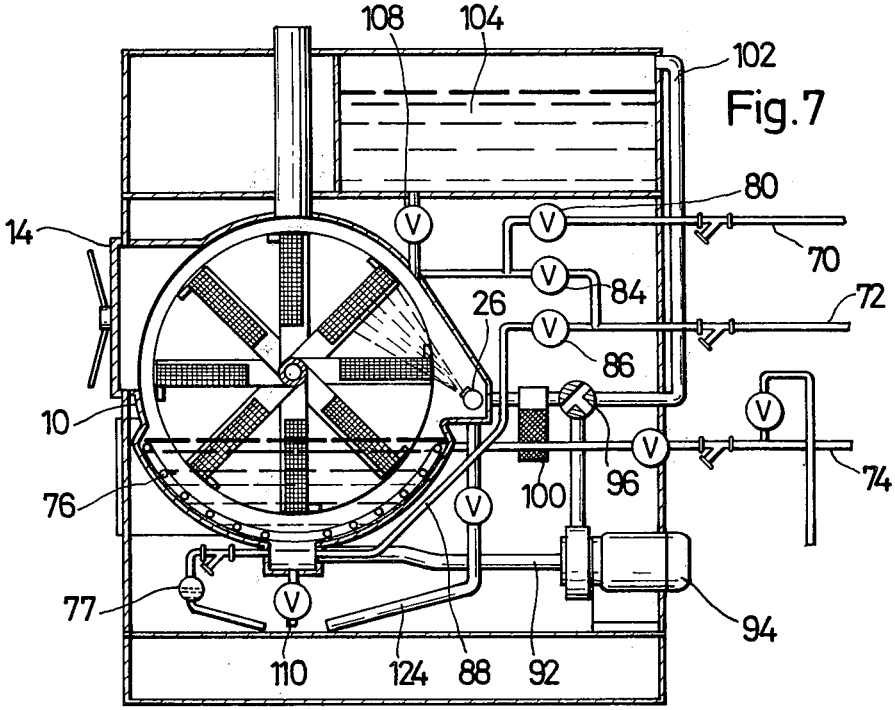
FIG. 7 is a view similar to FIG. 1, and illustrating an embodiment of the invention.

The embodiment of FIG. 7 illustrates the ducting system. Corresponding elements have been given the same reference numerals as FIG. 1, and a detailed explanation is not necessary.

Figure 8:
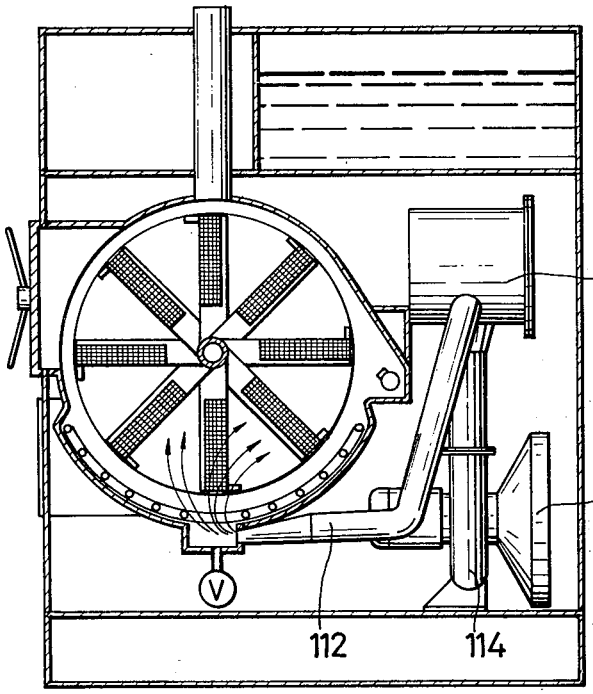
FIG. 8 is a view corresponding to FIG. 1 and illustrating an embodiment of the invention, with the drying system being illustrated in detail.

The air supply system is shown in more detail in FIG. 8; the same reference numerals as used in FIG. 1 have been used.

Various changes and modifications may be made within the scope of the inventive concept.

The illustration of FIG. 7 shows an actual layout of the piping of the apparatus of FIG. 1; the mounting of the pump motor 94, laterally of the vessel 10; and the positioning of pipe 124, with the interposed drain valve to function as an overflow, just below the spray pipe 26, so that the level of the fluid within the vessel 10 can be determined thereby. The air supply to the vessel has been omitted and is shown separately in FIG. 8; a large intake air filter supplies air to a centrifugal, or cage blower 114, the air being then transported to a fine filter 118, and in counterflow to the air supply pipe 112 which terminates at a lower portion of the vessel 110, to provide for complete flushing of the air through the vessel 110, and exhaust of the air from the vent 120 (FIG. 1).

I claim:

1. Bottle washing machine comprising a vessel (10) adapted to hold a treatment liquid;

a plurality of bottle holding boxes (22) adapted to hold the bottles (24) to be cleaned;

a rotatable frame (16) having a central shaft (28) located within the vessel, said frame including a plurality of spaced, radially extending arms (36) formed with box holding track means (42) for seating the bottom of the bottle holding boxes (22), said boxes being insertable between said arms (36) and being open at the top;

separable covers (44) for the boxes;

cover holding track means (50, 54) formed on the arms (36) to seat the covers over the boxes, at least one of said track means comprising a plurality of tracks spaced above each other to permit locating bottles of different heights in said boxes (22) and beneath said covers (44);

and drive means (36) coupled to the frame (16) to rotate the frame within the vessel, and hence expose the bottles in their holding boxes to the treatment liquid.

2. Machine according to claim 1, further comprising locking means (58, 64) engageable with said arms and said bottle holding boxes to lock said boxes in position between the arms.

3. Machine according to claim 1, wherein the box holding track means (42) extend radially to permit radial insertion of said boxes between said arms (36).

4. Machine according to claim 1, further comprising a substantially axially extending spray tube (26) located in said vessel (10) laterally with respect to the frame (16) and being formed with spray nozzles having a spray direction to spray upwardly and into the bottles to be treated and which become inverted upon rotation of the frame.

5. Machine according to claim 4, further comprising pump means (94) having its suction side connected to the vessel (10), and pipe means connecting the pump means (94) to the spray tube (26).

6. Machine according to claim 5, further comprising a supply tank (104) for treatment liquid, a drain connection (108) on the supply tank (104) connecting the supply tank (104) with the vessel (10);

the pump means (94) having its outlet connected to an inlet supply connection (102)

7. Machine according to claim 1, further comprising an overflow line (124) connected to the vessel to determine the maximum level of treatment liquid therein.

8. Machine according to claim 7, wherein the overflow level is set approximately midway between the highest and lowest positions of the bottles in the holding boxes upon rotation of the frame;

a substantially axially extending spray tube (26) is provided and located in the vessel (10) laterally with respect to the frame (16) and above the level of the overflow line and being formed with spray nozzles having a spray direction to spray upwardly into the bottles to be treated.

9. Machine according to claim 1, further comprising air supply means (112–120) including air cleaning means (116, 118) connected to supply clean air to the interior of the vessel (10).

10. Machine according to claim 1, further comprising a steam supply means (74, 100) connected to supply steam to the interior of the vessel to permit sterilization of bottles therein.

11. Machine according to claim 10, wherein the vessel (10) comprises a pressure vessel having such strength that the steam pressures used in sterilizing the bottles can be safely accepted by the vessel.

12. Machine according to claim 1, wherein the box holding track means (42) comprises a single track and the cover holding track means (50, 54) comprises a plurality of stacked guide tracks.

* * * * *

UNITED STATES PATENT AND TRADEMARK OFFICE

CERTIFICATE OF CORRECTION

PATENT NO. : 3,956,791

DATED : May 18, 1976

INVENTOR(S) : Werner RUTTEN

It is certified that error appears in the above-identified patent and that said Letters Patent are hereby corrected as shown below:

Claim 6; line 13, after "connection (102)" the following should be inserted: --of the supply tank (104)--

Signed and Sealed this

Tenth Day of August 1976

[SEAL]

*Attest:*

RUTH C. MASON
*Attesting Officer*

C. MARSHALL DANN
*Commissioner of Patents and Trademarks*